United States Patent [19]

Serretti, Jr.

[11] 3,994,051

[45] Nov. 30, 1976

[54] QUICK RELEASE FASTENER AND BRACKET ASSEMBLY FOR USE THEREWITH

[75] Inventor: Charles A. Serretti, Jr., Watchung, N.J.

[73] Assignee: Automatic Injection Molding, Inc., Berkeley Heights, N.J.

[22] Filed: Sept. 23, 1975

[21] Appl. No.: 615,987

[52] U.S. Cl. ..... 24/273

[51] Int. Cl.[2] ..... B65D 63/04

[58] Field of Search ..... 24/270, 271, 273, 206 A, 24/265 NS, 68 E, 68 F, 68 T, 20 R

[56] References Cited

UNITED STATES PATENTS

| | | | |
|---|---|---|---|
| 290,351 | 12/1883 | Parry | 24/273 |
| 991,192 | 5/1911 | Battenfeld | 24/270 UX |
| 2,466,742 | 4/1949 | Roehrl | 24/206 A |
| 2,654,926 | 10/1953 | Delafosse | 24/68 F X |
| 2,915,799 | 12/1959 | Andreasen | 24/270 |
| 3,276,089 | 10/1966 | Cheever et al. | 24/270 |
| 3,670,371 | 6/1972 | Swanson | 24/68 T |
| 3,805,988 | 4/1974 | Walker et al. | 24/68 T X |

FOREIGN PATENTS OR APPLICATIONS

| | | | |
|---|---|---|---|
| 199,008 | 10/1938 | Switzerland | 24/206 A |

*Primary Examiner*—Donald A. Griffin
*Attorney, Agent, or Firm*—Daniel H. Bobis

[57] ABSTRACT

A single or multi-section fastener capable of quick release is elongated so that one end will overlie the other end of the fastener in latched position, the overlying member or end is provided with a sized aperture therethrough and the underlying member or end includes, a tongue holder generally wider than the aperture which is connected by a flexible hinge to said underlying end to permit the tongue holder to fold so that it lies between the respective underlying and overlying end when the fastener is moved to the engaged or latched position. Movement of the fastener from the engaged or latched position to the disengaged or unlatched position to the disengaged or unlatched position is accomplished by a quick release assembly formed on the underlying end. A reinforced handle may be connected to the quick release assembly to facilitate release or disengagement of the cooperating ends of the fastener from the engaged or latched position.

Alternatively the tongue member if suitably elongated can be associated with a loop on the underlying member spaced inwardly of the latching post to prevent accidental release of the catch member from the engaged or latched position.

Additionally a fastener preferably made of molded plastic material having a releasable closure as above described, the fastener disposed in combination with a mounting bracket for detachably connecting or detachably holding a canister or portable fire extinguisher therein.

11 Claims, 21 Drawing Figures

QUICK RELEASE FASTENER AND BRACKET ASSEMBLY FOR USE THEREWITH

BACKGROUND OF THE INVENTION

The present invention relates generally to strap type fasteners and more particularly to a quick release fastener preferably made from a molded plastic material adaptable for a variety of uses.

One use of the present invention is in combination with a mounting bracket for detachably holding a fire extinguisher of the portable canister type. Heretofore various mounting bracket assemblies which included quick release straps have been utilized such as those shown in U.S. Pat. Nos. 3,224,720, 2,915,799 and 2,029,707.

In such prior art devices, safety dictated that under emergency conditions the strap fasteners for retaining the fire extinguisher on the mounting bracket be readily releasable by a simple uncomplicated motion which was communicated to the operator by a clear, imperative statement such as "Pull Here."

Further the strap fasteners for portable fire extinguisher type appliications must be of a type that can be used and reused to permit the necessary inspection and servicing of the fire extinguishing unit on a periodic basis.

The present invention provides an improved strap fastener of molded plastic material which is cheap to make and embodies all of the desirable characteristics that are required to meet these conditions of use and operation; more particularly as applied to the preferred application with a fire extinguisher; although it will be clear from the description that the strap fastener with a releasable closure in accordance with the present invention is adapted for many uses and applications.

SUMMARY OF THE INVENTION

Thus the present invention covers a fastener made of molded plastic material capable of quick release from assembled position having, cooperating end means therein wherein one end of the fastener overlies the other end thereof in assembled position, said overlying end of the fastener having an aperture therethrough and the underlying end having a tongue holder generally wider than the aperture connected to the underlying end by a flexible hinge means to permit the tongue holder to fold substantially against the adjacent portion of the underlying end so that the tongue holder lies between the underlying end and the overlying end when the ends are in cooperative engagement with each other, a tongue member connected to the tongue holder on the side remote from the connection to the flexible hinge is sized to extend through the aperture when the underlying end and overlying end are assembled into cooperative engagement with each other, and a releasable latching means for the fastener including, a latching post on the fastener a spaced distance from the flexible hinge and on the side opposite from the tongue holder, catch means on the tongue member disposed by movement of the tongue for engagement and disengagement of the latching post, and means on the latching post operatively associated with the folded tongue member to exert an affirmative force to prevent accidental disengagement of the catch means from the engaged position on the latching post.

Additionally the fastener above described and a reinforced handle means connected to said tongue member having at least one leg continuous with the tongue member, and a second leg substantially normal to the tongue member to facilitate manual access for releasing the tongue member from engagement with the latching post.

Additionally, the combination of a quick release fastener as above described and a mounting bracket for detachably holding a canister or portable fire extinguisher therein.

Accordingly, it is an object of the present invention to provide an improved quick release fastener.

It is another object of the present invention to provide a fastener which is made of plastic material and has a quick release assembly thereon including, a latching post and operatively associated catch means which require a predetermined force to effect opening of the latch means.

It is another object of the present invention to provide a quick release fastener and bracket assembly for holding and releasing a portable fire extinguisher or canister.

Other objects and advantages of the invention will be set forth in the following descriptions and claims and illustrated in the accompanying drawings which disclose by way of example the principles of the invention and the best modes thereof:

Figure 1:
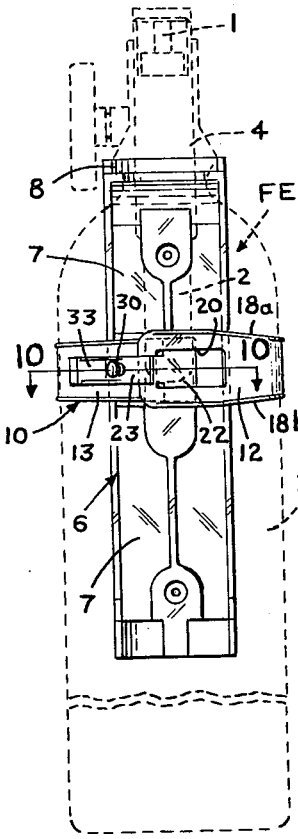
FIG. 1 is a front view of a bracket assembly having a quick release fastener in accordance with the present invention for releasably mounting a portable fire extinguisher shown therein in phantomized form.
Figure 2:
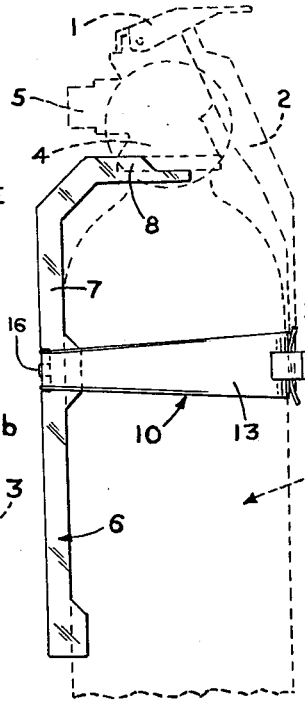
FIG. 2 is a left side view of the bracket assembly and quick release fastener shown in FIG. 1 of the drawings.
Figure 3:
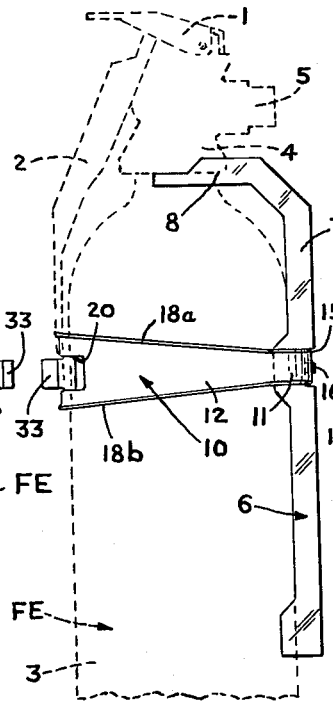
FIG. 3 is a right side view of the bracket assembly and quick release fastener shown in FIG. 1 of the drawings.
Figure 4:
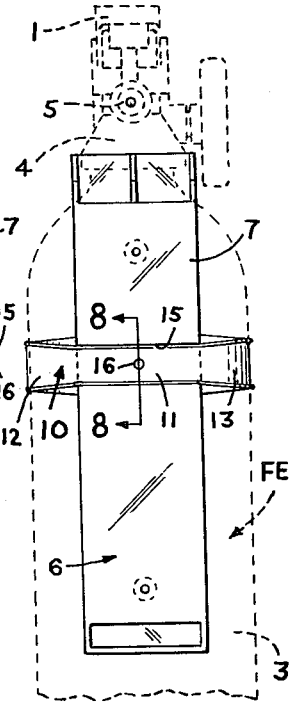
FIG. 4 is a back view of the bracket assembly and quick release fastener shown in FIG. 1 of the drawings.

One preferred embodiment of a quick detachable release fastener in accordance with the present invention is for a portable fire extinguisher. Such extinguishers include a cylinder which contains a chemical compound for ejection therefrom under pressure to control or extinguish a fire.

FIGS. 1 to 5 show this application with the fire extinguisher generally designated FE in phantomized form. The fire extinguisher has an operation lever 1 connected to an actuating handle 2. The actuating handle 2 extends generally down from the operating lever and in non-operating position lies along and generally parallel to the outside of the cylinder 3. The operating lever 1 is connected to a valve arrangement, not shown, in the neck 4 of the cylinder 3 and the valve arrangement has suitable passage means connecting to a nozzle 5 for delivering the chemical compound to be ejected from the fire extinguisher.

In this type of extinguisher the handle 2 must be swung upwardly in order to enable the chemical compound contained under pressure in the cylinder 3 to be ejected from the nozzle 5 thereon.

The structure and operation of such fire extinguishing devices of the type shown are well known. However, because this device does not form part of the present invention it is not more fully described.

FIGS. 1 to 9 show that there is associated with the fire extinguisher FE a bracket assembly generally designated 6 for mounting the fire extinguisher to any suitable point for access thereto in the event of fire.

The bracket assembly 6 is an L-shaped member having an elongated leg 7 and a short U-shaped leg or cradle 8 extending at right angles thereto so that in assembled position the neck 4 of the fire extinguisher FE will engage and fit in the cradle 8 and the cylinder 3 will lie substantially parallel and adjacent to the elongated leg 7. Further, however the elongated leg 7 will be positioned to lie on the side of the cylinder opposite from that of the actuating handle 2 for reasons that will appear clear from the description that follows.

Connected to the middle section of the elongated leg 7 is a quick release fastener 10 in accordance with the present invention which acts to hold the fire extinguisher FE and to permit the same to be released quickly from the bracket assembly 6.

Fastener 10 in this form of the invention is a unitary elongated relatively thin and easily bendable member which is preferably manufactured from polypropylene by any suitable injection molding technique.

It will be understood by those skilled in the art that other thermoplastic material such as polyethylene and nylon adaptable for use in injection molding techniques may also be used as may other methods of manufacture and materials which can provide the required shape and dimension for the strap fastener as is more fully set forth hereinafter without departing from the scope of the present invention.

Thus by reference to FIGS. 1 to 10 of the drawings fastener 10 is shown as a continuous member having a narrow central section 11 with a cooperating overlying end as at 12 on one side and an underlying end as at 13 on the opposite side. The overlying end 12 is slightly wider than the underlying end 13 for purposes which will appear clear in the description below of the quick release latching means for the fasteners.

The central section 11 is provided with a connecting opening 14 which is located at about the mid-point of the strap fastener 10. When the central section 11 is placed in a transverse groove 15 on the outer face of the elongated leg 7 of the L-shaped bracket assembly 6 the connecting opening 14 will engage a rivet or post 16 disposed in the transverse groove 15 as is shown in FIGS. 2, 3, 4, 5 and 8 of the drawings.

Since the cylinder 3 of the extinguisher FE will engage the inner face of the L-shaped bracket assembly 6 in assembled position, the fastener 10 when so connected in the transverse groove 15 of the L-shaped bracket assembly 6 by reason of the relatively thin and bendable character thereof may be easily contoured to fit about the cylinder 3 to bring the cooperating overlying end 12 and underlying end 13 into operative association with each other for detachably holding the fire extinguisher FE in assembled position in the L-shaped bracket assembly 6 and to permit the quick release thereof by reason of the quick release latching means formed on the cooperating overlying end 12 and underlying end 13 as is more fully described below.

Innerface 17 of the fastener 10 is smooth. However for dimensional stability and consistent with good injection molding manufacturing techniques reinforcing ribs at 18A and 18B are disposed to extend along the side edges of the outer face of the fastener 10 from a point inwardly of the relatively wide section of the overlying end to a point medially between the connecting opening and the end of the underlying end 13.

CLOSURE ASSEMBLY

To adapt the L-shaped bracket assembly 6 and the fastener 10 to detachably mount the fire extinguisher FE it is necessary that the fastener 10 have a quick release closure assembly that will be both firm and positive, will not spontaneously open, and further will meet the ordinances and laws applicable to such closure assemblies which require that at least five tenths of a pound (0.5 lb) be applied before the closure will commence opening.

On the present fastener this is accomplished by so constructing the cooperating overlying end 12 and underlying end 13 to exert an affirmative force perpendicular to the longitudinal axis of the closure assembly and by providing interengaging means on the closure assembly which must be pulled or separated from each other by a force at least equal to or greater than the required minimum of five tenths of a pound (0.5 lb).

Thus referring to FIGS. 6 to 13 the overlying end 12 is shown as having in the widest end section thereof a sized aperture 20 which is rectangular in plan view and will coact with elements of the quick release closure assembly formed on the cooperating underlying end 13.

Thus on the underlying end 13 a flexible hinge is formed as at 21 a spaced distance inwardly from the end of the widest section of the underlying end to define a tongue holder 22.

The flexible hinge 21 is transverse to the longitudinal axis of the fastener 10 and is formed from the inner surface 17 of the fastener by reducing the thickness of the fastener at the point where the flexible hinge 21 is formed.

If the material selected for the fastener particularly in the case of plastic material has the proper characteristics which will support repeated 180° bending or folding of the material upon itself without fracture at the point where the hinge is formed in the plastic material then such flexible hinge is known in the trade as a "living hinge" which is the type of hinge particularly adaptable to the fastener formed in accordance with the present invention.

It is therefore desirable in the selection of the material for the fastener in accordance with the present invention that such material have the physical characteristics when a transverse reduced section is formed therein to support repeated 180° folding or bending at such point, and still remain free of fatigue stresses which would cause fracture of the material from which the fastener is made at the bending point.

Tongue holder 22 is also generally rectangular in plan view and is sized larger than the aperture 20. Further, at the end of the tongue holder 22 remote from the flexible hinge 21 a tongue member 23 is formed having a width which is substantially less than the aperture 20 and the tongue member 23 extends in the longitudinal line of the fastener 10 so that when the tongue holder 21 is folded so that the tongue holder lies against the outer face of the underlying end 13 of the fastener and the underlying end 13 is brought into operative association with the overlying end 12 the tongue member 23 will pass freely through the aperture 20 as is clearly shown in FIGS. 1, 5, 6 and 10 of the drawings.

The tongue member 23 is provided with a second flexible hinge 24 a spaced distance outwardly of the tongue holder 22 which is formed from the outer surface of the fastener by reducing the thickness of the fastener at the point where the flexible hinge 24 is formed.

Figure 6:
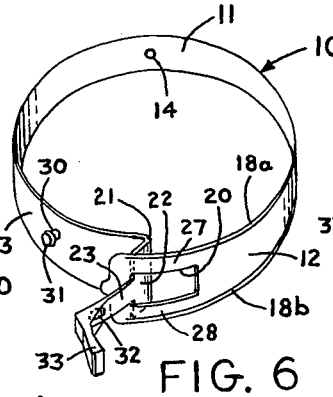
FIG. 6 is a perspective view of a partially closed quick release fastener of the type shown in FIG. 1 of the drawings.
Figure 7:
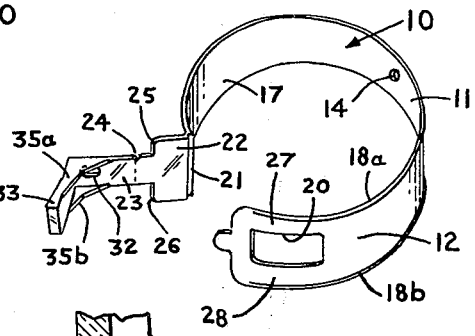
FIG. 7 is a perspective view of the quick release fastener shown in FIG. 6 in the open position.
Figure 9:
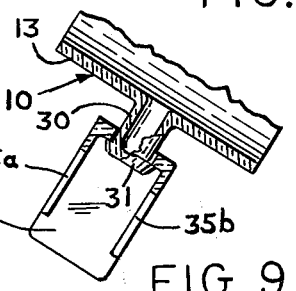
FIG. 9 is a vertical section taken on line 9—9 of FIG. 5 showing the latching post and catch means for the quick release fastener shown in FIGS. 1 — 7 of the drawings in the closed position.
Figure 8:
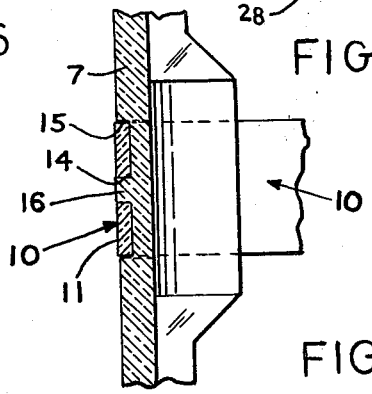
FIG. 8 is a vertical section taken on line 8—8 of FIG. 4 showing the means for connecting the quick release fastener to the bracket member of the bracket assembly shown in FIGS. 1 — 5 of the drawings.

Since the respective first flexible hinge 21 and the second flexible hinge 24 are formed from the respective inner and outer surfaces of the fastener 10, the tongue member 23 can be easily drawn through the aperture 20 and will extend over and beyond the overlying end 12 until the spaced shoulders as at 25 and 26 formed on the tongue holder on opposite sides of the tongue 23 engage the side sections 27 and 28 of the wider section of the overlying end 12 on opposite sides of the aperture 20 as shown in FIGS. 1 and 6 of the drawings.

Figure 5:
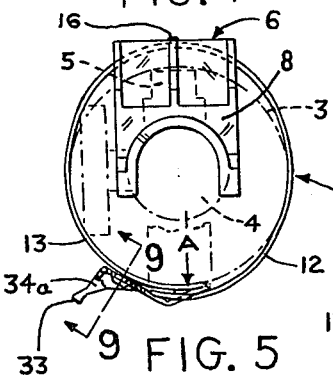
FIG. 5 is a top view of the bracket assembly and quick release fastener shown in FIG. 1 of the drawings.
Figure 10:
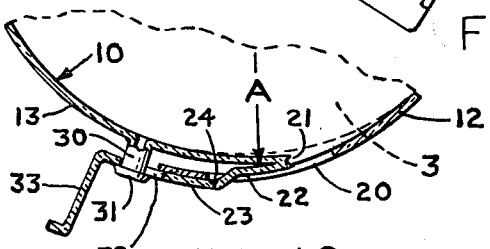
FIG. 10 is a horizontal section taken on line 10—10 of FIG. 1 showing a fragment of the quick release fastener shown in FIGS. 1 — 7 of the drawings with the latching post and closure means on the tongue in closed position.
Figure 11:
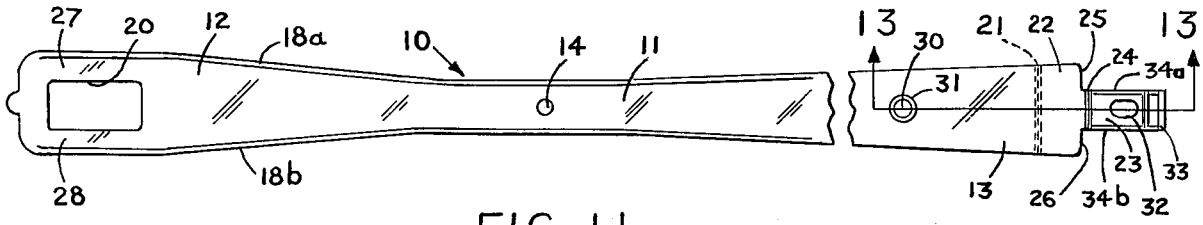
FIG. 11 is a plan view of the form of quick release fastener shown in FIGS. 1 to 10.
Figure 12:
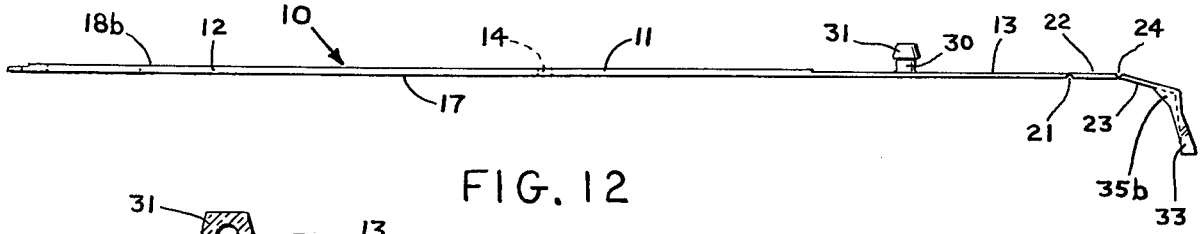
FIG. 12 is a side view of the form of quick release fastener shown in FIG. 11.
Figure 13:
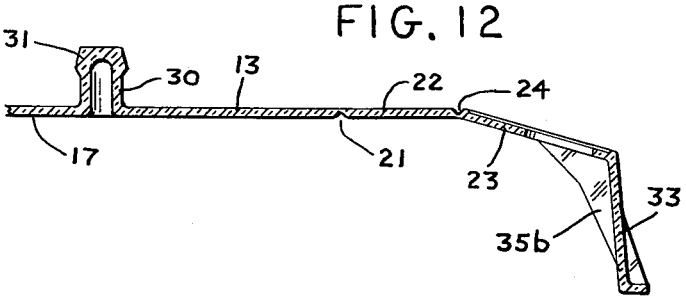
FIG. 13 is an enlarged fragmentary view in cross-section of one end of the quick release fastener shown in FIGS. 11 and 12 showing the tongue holder, tongue member, handle and latching post thereon.

Further when this relationship is established as shown in FIGS. 1, 5 and 10 the tongue holder 23 will lie or be positioned between the overlying end 12 and the underlying end 13 and when in assembled position will act to exert an outward force between these elements normal to the longitudinal line of the fastener generally in the direction of the Arrow A as shown in FIGS. 5 and 10 of the drawings.

The degree of positive force exerted by this construction will depend upon the degree of force required to establish latching between the tongue member 23 and a latching post 30 which is formed on the outer surface of the underlying end 13 a predetermined spaced distance from the first flexible hinge 21 and from the cooperating overlying end 12 and underlying end 13 when they are in assembled position also as shown in FIGS. 1, 5 and 10 of the drawings.

The latching post 30 is substantially cylindrical in shape and projects from and in a line normal to the outer surface of the fastener 10.

An annular abutment of annular shoulder 31 is formed about the upper end of the latching post 30 at approximately a spaced distance from the outer surface equal to or about twice the thickness of the underlying end 13 so that when the tongue member 23 is pulled through and across the end of the overlying end 12 a catch means generally designated 32 in the form of an opening centered in the tongue member 23 can be secured to the latching post 30 by pressing the same over the annular abutment 31 as is shown at FIGS. 1, 5 and 10 of the drawings. The opening 32 is preferably elliptical to permit the annular abutment or annular shoulder 31 to be sized to provide the desired degree of opening force and to provide an additional means of insuring continued engagement when the cooperating ends 12 and 13 are in the engaged or latched position.

It is thought clear from these figures that the predetermined distance that the latching post 31 is disposed from the first flexible hinge 24 will be a function of the degree of overlap between the overlying end 12 and underlying end 13 of the fastener 10 and the length of the tongue member 23.

Since, the first flexible hinge 21 and the second flexible hinge 24 are formed from opposite surfaces of the fastener 10 when the tongue member is pulled through the aperture 20 so that the catch means 32 can engage the latching post 30 the effect thereof would be to permit the tongue 23 to lie substantially parallel to the underlying end 13 and further to cause an upward force to be exerted by the tongue holder 22 as indicated by the Arrow A and more particularly shown in FIGS. 5 and 10 of the drawings.

To facilitate quick release of the fastener 10 a rigid L-shaped handle 33 having one leg connected to the tongue 23 and the other leg normal to the axis of the tongue. The handle 33 will have an approximate width equal to that of the tongue 23 so that it may be easily inserted through the aperture 20 when the latching means for the closure assembly is formed.

Further reinforcing ribs are provided as at **34*a* and 34*b* on the tongue member and on the L-shaped handle supporting straps as at 35*a* and 35*b* in the form of side wall members are provided between the handle 33 and the tongue member 33 for both rigidity and to dispose the handle substantially normal to the plane of the tongue member 23 when the cooperating ends 12 and 13** in the overlying position.

In the use of the fastener 10 the fastener is first mounted onto the back surface of the L-shaped bracket assembly 11 in the transverse groove 15 by means of the connecting rivet 16 as above described.

The bracket is then installed against a wall or other suitable point of access and the fire extinguisher FE or any other suitable type of device is installed.

In the preferred application illustrated the fire extinguisher FE is first hung in the bracket by engaging the neck 4 of the fire extinguisher FE in the U-shaped cradle 8 and then moving the fire extinguisher against the elongated section 7 to permit the fastener 10 to be wrapped about the fire extinguisher FE until the cooperating overlying member 12 and underlying member 13 are brought into engagement with each other. By folding the tongue holder 22 back against the outer face of the underlying member 13 the tongue member 23 and handle 33 can be passed through the rectangular aperture 20 until the shoulders 25 and 26 abut the sides 27 and 28 of the aperture 20. Tongue member 23 can then be passed over the end of the overlying member 12 until the catch means 32 is brought in engagement with the latching post 30 and moved below the angular abutment or shoulder 31 thereon.

The fastener 10 being made of plastic material is designed with a limited coefficient of expansion and therefore is provided with a substantially fixed length designed to service a fire extinguisher FE or canister of a given circumference.

The effect of this construction is to create a non yielding force or tension on the inner face on the fastener by reason of the engagement with the outer surface of the fire extinguisher FE or canister in the bracket so that the forces exerted by the paced living hinges at 21 and 24 will be exerted normal or perpendicular to the longitudinal line of the fastener in the direction indicated by the Arrow A in FIGS. 5 and 10 in the drawings as has been above described.

The effect of this construction is to permit a relatively light pulling force to be exerted on the handle 33 in the same direction as the force A normal to the longitudinal line until the catch means on the tongue member 23 is pulled free of the annular abutment or shoulder 31 on latching post 30.

Since all of the retaining forces and the pulling forces are moving in the same direction a relatively light force in excess of the required five tenths of a pound (0.5 lb) can be used to separate the overlying member from the underlying member and thus permmit the fire extinguisher FE to be removed from the L-shaped bracket assembly for use.

MULTI-SECTION FASTENER

The fastener shown in FIGS. 1 to 13 of the drawings is a unitary type of fastener used in applications for releasably holding a tank canister or fire extinguisher of a given circumference.

Figure 14:
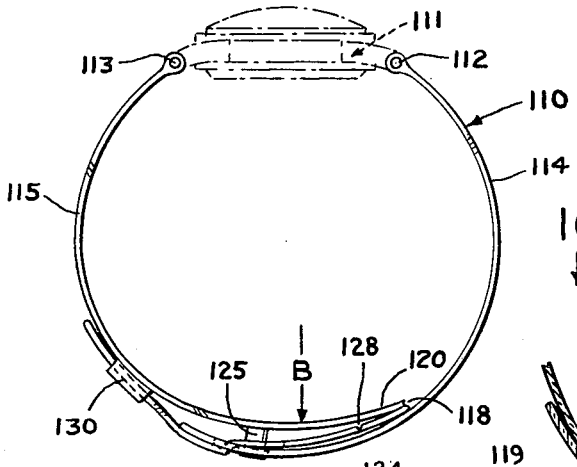
FIG. 14 shows an alternate form of the present invention wherein a quick release fastener in accordance with the invention is shown in side elevation as formed by two sections which may be fastened to opposite sides of an article such as a wrist watch shown in phantomized form.
Figure 21:
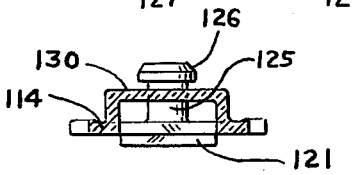
FIG. 21 is a cross-section taken on line 21—21 of FIG. 20.

It is however within the scope of the present invention to make the fastner in more than one section which can be fastened on either side of a device such as a watch or other article and this type of multi-section fastener in accordance with the present invention is illustrated in the drawings at FIGS. 14 and 21.

Thus referring to FIGS. 14 to 21 a multi-section fastener 110 is illustrated as applied to a watch generally designated 111. On opposite sides of watch 111 are conventional connecting members as at 112 and 113 which permit one respective end of an overlying section 114 and an underlying section 115 of the fastener 110 to be connected so that they extend in opposite direction from watch 111 as is clearly shown in FIGS. 14 and 18 of the drawings.

The overlying member 114 similar to the form of the invention shown in FIGS. 1 to 13 of the drawings and above described includes, reinforcing ribs as at 116A and 116B and just inwardly of the end of the overlying member remote from the end connected to the watch 111 a sized aperture 117.

In the case of the underlying member FIGS. 14, 16, 18, 19 and 20 show that at the end remote from the end connected to the watch 111 there is a flexible hinge 118 defines a connecting tongue holder 119, the flexible hinge 118 is formed by striking a groove on inner face 120 of the underlying member 115 so as to provide a reduced thickness in the plastic material from which the fastener 110 is made.

Where the fastener 110 and more particularly the underlying member 115 are made from plastic materials such a polypropylene or other thermoplastic materials such a polethylene, nylon, etc., there will be established by this construction a device which is termed in the trade a "living hinge" which represents a device that can be repeatedly folded upon itself 180° without exhibiting fatigue as normally occurs in various other materials.

Thus the tongue holder 119 can be folder onto the outer face of the underlying member in the same manner as was above described for the underlying member of the form of the invention shown in FIGS. 1 to 13 of the drawings.

On the side or edge of the tongue holder 119 remote from the flexible hinge an elongated tongue member 121 is connected.

Figure 15:
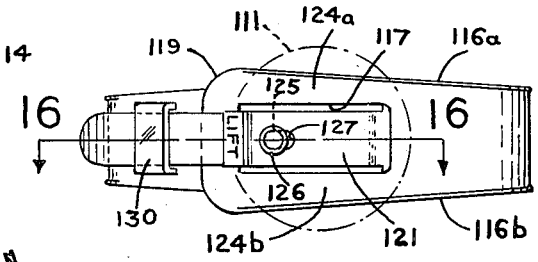
FIG. 15 shows a front view of the fastener shown in FIG. 14.
Figure 18:
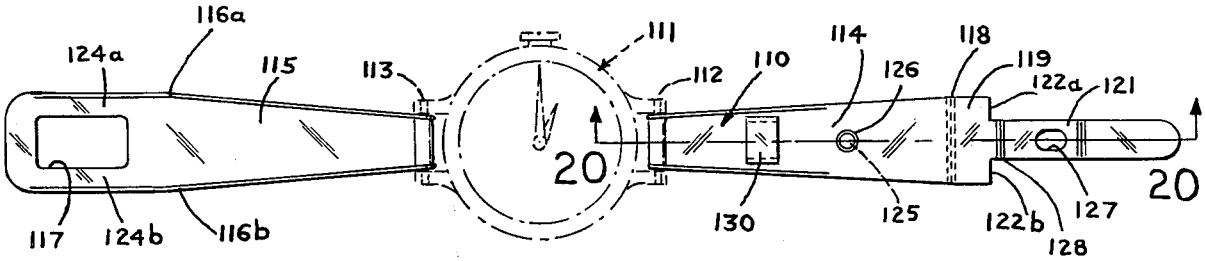
FIG. 18 is a top plan view of the multi-section quick release fastener and wrist watch shown in FIG. 14.
Figure 19:
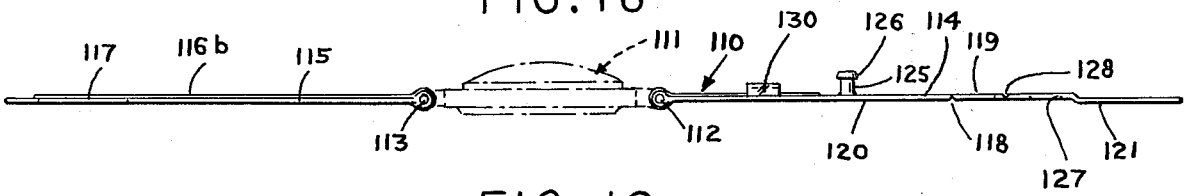
FIG. 19 is a side view of the multi-section quick release fastener and wrist watch shown in FIGS. 14 and 18.
Figure 20:
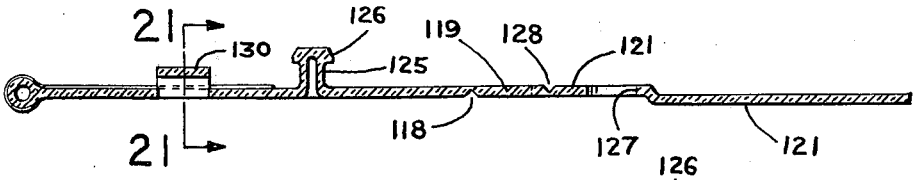
FIG. 20 is an enlarged cross section of the section of the multi section quick release fastener having the latching elements thereon.

FIGS. 15 and 18 show that the tongue holder has a width greater than the sized aperture 113 while the tongue member 122 which is centered on the longitudinal line of the underlying member 115 is substantially narrower than the sized aperture 117 and thus forms on opposite sides of this edge of the tongue holder spaced shoulders as at **122*a* and 122*b*.**

When the overlying end and underlying end are brought into cooperative assocation the tongue holder 119 is folded back on the outer face of the underlying member so that in assembled postion for closing the members it will lie between these members and thus permit the tongue member 119 to be pulled through the aperture 117 so that the shoulders **122*a* and 122*b* engage the side members 124*a* and 124*b* by the overlying member 114 at some point there along as a function of the circumference of the member about which the fastener 110 is attached. Thereafter the tongue member is then passed over the end of the overlying member 115** which it will engage a latching means to hold these elements buckled together now to be described.

Figure 17:
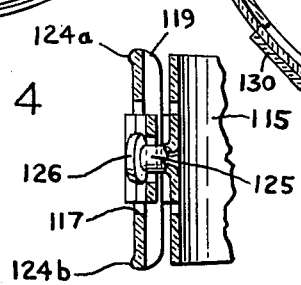
FIG. 17 is a cross sectional view taken on line 17—17 of FIG. 16.
Figure 16:
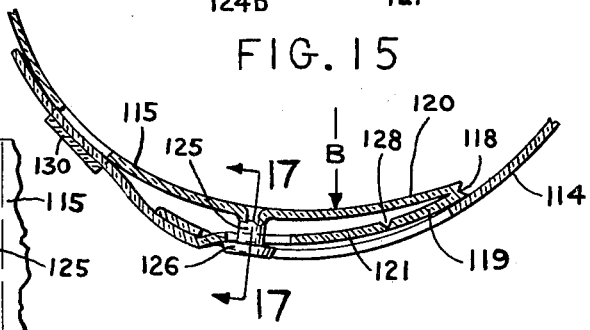
FIG. 16 shows an enlarged view in cross section of the cooperating ends of the quick release fastener shown in FIGS. 14 and 15.

The latching means includes a latching post 125 which is disposed a spaced distance from the flexible hinge 118 and from the cooperating end of the overlying member 114 and underlying member 115 when they are in assembled position as shown in FIG. 17.

The latching post projects from and normal to the outer surface of the underlying member 115 and has an annular abutment or shoulder 126 about the end thereof approximately a distance twice the thickness of the underlying member 115.

The tongue member as shown in FIGS. 14 and 17 has a catch means or opening 127 preferably elliptical so that when the tongue member 122 is pulled through the aperture 20 and over the end of the overlying end of the overlying member 114, the catch means 127 can be brought into engagement with the latching post 125. Since the elliptical opening 127 is larger than the annular abutment 126 it can pass over the same when brought into such engagement, and the sized abutment will act to maintain engagement between these elements of the latching means.

Further by reference to FIGS. 15, 16, 18, 19 and 20, the tongue member 121 is shown to have a second flexible hinge 128 thereon on the side where the tongue is connected to the edge of the tongue holder but this flexible hinge is formed by means of a transverse groove stuck in the outer surface of the underlying member 115. Thus, when the tongue member 121 is moved for latching engagement with the latching post 125 the tongue will be substantially parallel to the underlying member 115 and will transmit forces towards the tongue holder 119 which forces will be acting perpendicular to the longitudinal line of the axis for the fastener in the direction of the Arrow B as is shown in FIGS. 14 and 17. This force will cause the catch means 127 to engage and hold the latching post 125 so as to prevent separation of the overlying member from the underlying member when these elements are in latched position.

Further a loop 130 is formed a spaced distance from the latching post 1 on the side of the closure means remote from the interengaging and cooperating ends of the overlying member 114 and underlying member 115. The elongated end of the tongue member 121 in the longitudinal axis of the fastener may be brought into engagement with the loop 131 to prevent accidental escape of the tongue member 121 from the latched position.

In use the object will be placed in position on the point where it is to be attached and the respective underlying section 114 and overlying section 115 of the fastener are bent around until the ends of the respective underlying section and overlying section are in engagement with each other.

The tongue holder 119 will be bent back onto the outer face of the underlying section and the tongue member 121 will be brought through the aperture 117 until the catch means 127 is brought into engagement with the latching post 125. Depending on the size of the point of attachment, the underlying member 115 will slide more or less within the range of the respective sections of the fastener 110 until the shoulders as at 123a and 123b come into engagement with the side sections 124a and 124b on opposite sides of the sized aperture 117 in the overlying member 114.

However, before the tongue member 121 is latched to the latching post 125, the extended end thereof is passed through the loop 131 and then the fastener is placed in the latched position.

To remove or disengage the respective sections of the fastener 110 the tongue member 121 is snapped open by separating the catch means from the latching post 125. The sized aperture 117 can then be easily lifted off and the overlying member 114 separated from the underlying member 115.

Thus there have been described two forms of the present invention, one providing a quick release fastener particularly adaptable with a bracket for releasably holding a portable fire extinguisher or a removable canister and the other adapted to provide means for removably holding an object such as a watch to a point of attachment.

It will be understood that these are only representative illustrations and that a fastener device in accordance with the present invention is adapted to many other and diifferent applications without departing from the scope of the present invention.

While the foregoing description illustrates various preferred embodiments of the present invention, it will be appreciated that certain changes and modifications may be made in the structure of these disclosed arrangements without departing from the spirit and scope of the invention and that the same is defined by the claims as hereinafter set forth.

What is claimed is:

1. A fastener comprising, a. means for connecting the fastener in assembled position, b. said fastener having a first elongated member connected to one side of the connecting means and having a free end remote from the connected end, and a second elongated member connected to the opposite side of the connecting means and also having a free end remote from the connected end, c. said first member and said second member disposed in substantial alignment with each other and movable so that the free ends are disposed in cooperative association with each other whereby said first member will overlie the second member, d. said first member having a sized aperture therein, e. closure means formed on said second member, f. said closure means disposed for operative engagement through the aperture on the first member to hold the fastener in the latched position, g. means on said closure means to exert a force perpendicular to the axis of alignment of the first member and second members to prevent accidental opening when the fastener is in assembled position including;

1. a first flexible hinge at one end of the second member movable through an arc of 180°,
2. a tongue holder connected to the flexible hinge and adapted to be folded back onto the second member so as to lie between the free ends when the first member and second member are brought into cooperating relationship,
3. an elongated tongue member on said tongue holder disposed to form shoulder means on said tongue holder,
4. said tongue member having a second flexible hinge thereon and extendable through said aperture until said shoulder means engages the first member adjacent the aperture therein,
5. a latching post disposed a spaced distance from the flexible hinge,
6. an annular shoulder on said latching post, and
7. catch means on the tongue member disposed to engage the latching post to hold the free ends in latched position.

2. In a fastener as claimed in claim 1 wherein the fastener is molded from a plastic material as a unitary member.

3. In a fastener as claimed in claim 1 wherein the fastener is molded from a plastic material selected from the group consisting of polypropylene, polyethlene and nylon.

4. In a fastener as claimed in claim 1 wherein the closure means further includes, a. a handle, b. said handle connected to the tongue member to facilitate the application of forces to disengage the overlying member and underlying member from the engaged position.

5. In a fastener as claimed in claim 1 wherein, a. said fastener is molded from a plastic material selected fromm the group consisting of polypropylene, polyethylene, and nylon, and b. peripherally located reinforcing ribs formed along at leastt a portion of the length of said fastener.

6. In a fastener as claimed in claim 1 wherein the fastener is molded from a plastic material and has two separate sections, and the cooperating ends are formed on the respective ends of each of the separate sections.

7. In a fastener as claimed in claim 6 wherein, a. the section having the underlying end has a loop means thereon inwardly of the point of engagement between the cooperating ends, b. a strap on the underlying end extending beyond the tongue member and c. said strap in alignment with the tongue member and disposal for engagement with the loop before the catch means on the tongue member is brought into engagement with the latching post.

8. A bracket assembly for removably holding an object therein comprising, a. a bracket member having, means to receive the object therein, b. a fastener having connecting means thereon, c. means on said bracket to connect the connecting means for the fastener on said bracket, d. said fastener having a first elongated member connected to one side of the connecting means and having a free end remote from the connected end, and a second elongated member connected to the opposite side of the connecting means and also having a free end remote from the connected end, e. said first member and said second member disposed in substantial alignment with each other and movable to engage about the object to be held so that the free ends are disposed in cooperative association with each other whereby the first member will overlie the second member, f. said first member having a sized aperture, g. closure means formed on said second member, h. said closure means disposed for operative engagement through the aperture on the first member to hold the fastener in latched position about the object to be held, and i. means on the closure means to exert a force perpendicular to the axis of alignment of the first member and the second member to prevent accidental opening when the fastener is in assembled position including;

1. a first flexible hinge at one end of the second member movable through an arc of 180°,
2. a tongue holder connected to the flexible hinge and adapted to be folded back onto the second member so as to lie between the free ends when the first member and second member are brought into cooperating relationship,
3. an elongated tongue member on said tongue holder disposed to form shoulder means on said tongue holder,
4. said tongue member having a second flexible hinge thereon and extendable through said aperture until said shoulder means engages the first member adjacent the aperture therein,
5. a latching post disposed a spaced distance from the flexible hinge,
6. an annular shoulder on said latching post, and
7. catch means on the tongue member disposed to engage the latching post to hold the free ends in latching position.

9. In a bracket assembly as claimed in claim 8 wherein the fastener is molded from a plastic material selected from the groups consisting of polypropylene, polyethylene and nylon.

10. In a bracket assembly as claimed in claim 8 wherein the closure means for the fastener further includes, a. a handle, b. said handle connected to the tongue member to facilitate the application of forces to disengage the overlying member and underlying member from the engaged position.

11. In a bracket assembly as claimed in claim 8 wherein the forces exerted by the last mentioned means are in the order of 0.5 lbs.

* * * * *